US007081707B2

(12) United States Patent
Lee et al.

(10) Patent No.: US 7,081,707 B2
(45) Date of Patent: Jul. 25, 2006

(54) WAVEGUIDE SYSTEM FOR ELECTRODELESS LIGHTING DEVICE

(75) Inventors: Tae-Ho Lee, Gyeongsangbuk-Do (KR); Eui-Joon Park, Gyeongsangbuk-Do (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 11/032,286

(22) Filed: Jan. 10, 2005

(65) Prior Publication Data

US 2006/0002132 A1 Jan. 5, 2006

(51) Int. Cl.
*H01J 7/46* (2006.01)
*H01J 25/50* (2006.01)

(52) U.S. Cl. ..... 315/39; 315/39.55

(58) Field of Classification Search ..... 315/34, 315/39, 39.51, 39.55, 248; 333/17.3, 227; H01J 7/46, H01J 25/50
See application file for complete search history.

(56) References Cited

U.S. PATENT DOCUMENTS

| | | | | |
|---|---|---|---|---|
| 3,993,927 | A * | 11/1976 | Haugsjaa et al. | 315/39 |
| 5,525,865 | A * | 6/1996 | Simpson | 315/39 |
| 5,877,712 | A * | 3/1999 | Kim | 341/68 |
| 6,046,545 | A * | 4/2000 | Horiuchi et al. | 315/39 |
| 6,049,170 | A * | 4/2000 | Hochi et al. | 315/39 |
| 6,960,885 | B1 * | 11/2005 | Kim et al. | 315/39 |
| 2002/0105276 | A1 * | 8/2002 | Jeon | 315/5.13 |

OTHER PUBLICATIONS

Office Action issued by Russian Patent Office in connection with corresponding application No. 2005-101039 on Dec. 13, 2005.

English translation of Office Action issued by Russian Patent Office on Dec. 13, 2005 in connection with corresponding Russian application No. 2005-101039.

English translation of Russian associate's comments on Dec. 13, 2005 Office Action issued against Russian application No. 2005-101039.

*VHF Antennas*, G. Z. Ayzenberg, et al., vol. 2, Moscow, Svjaz, 1977, pp. 180-181 (untranslated).

* cited by examiner

*Primary Examiner*—Thuy Vinh Tran
(74) *Attorney, Agent, or Firm*—Ostrolenk, Faber, Gerb & Soffen, LLP

(57) ABSTRACT

Provided is a waveguide system for an electrodeless lighting device, comprising a waveguide guiding microwave energy outputted from an antenna of a microwave generation means which is fixedly-inserted into an inner surface of the waveguide, and having a slot formed at an inner surface of the waveguide and communicated with a resonator where a bulb is positioned for supplying the microwave energy inside the resonator, a first stub protruded from one inner surface of the waveguide to be placed adjacent to the slot, for an impedance matching with the antenna and tuning with an output frequency of the antenna; and a second stub protruded from an inner surface of the waveguide at a certain interval with the first stub and extending a bandwidth together with the first stub for tuning with the output frequency of the antenna is varied according to an impedance variation of the antenna, thereby enabling a supply of a maximal microwave energy outputted from an antenna to the resonator, and assuring of a resonance stability.

11 Claims, 6 Drawing Sheets

WAVEGUIDE SYSTEM FOR ELECTRODELESS LIGHTING DEVICE

BACKGROUND OF THE INVENTION

1. Field of the Invention

The present invention relates to a waveguide system for an electrodeless lighting device, and particularly, to a waveguide system for an electrodeless lighting device which has a compact size and is capable of supplying the mostest microwave energy into a resonator.

2. Description of the Background Art

In an electrodeless lighting device, microwave power generated from an antenna of a magnetron, a power source, is transmitted to a resonator through a waveguide, and the microwave power is applied to an electrode light bulb installed in the resonator so that the light bulb radiates visible rays or ultraviolet rays. In general, its life is prolonged in comparison with a glow lamp or a fluorescent lamp, and a lighting effect thereof is excellent.

As aforementioned, in order to supply the resonator with the mostest microwave energy generated from the antenna of the magnetron, an impedance matching between the antenna of the magnetron and the waveguide or between the waveguide and the resonator should be well achieved and tuning with respect to an output frequency of the magnetron should be also well realized. Furthermore, a frequency adaptation should be satisfied depending on an impedance variation of the magnetron.

In order to satisfy aforementioned conditions, as an example for the conventional art, a three-stub tuner system has been well known, in which a length from the magnetron antenna to a slot of the waveguide is fixed by three eighth of a guided wavelength ($\lambda_g$) for always matching it with an arbitrary impedance of the magnetron antenna. However, because the length of a waveguide can be lengthened in the system, it is difficult to implement a compact system and there could exist many different ways for tuning a resonant frequency.

Moreover, as another example of the conventional art, a technique adopting a conductive stub in case that the length from the antenna of the magnetron to the slot of the waveguide is shorter than half of the guided wavelength ($\lambda_g$) is introduced in U.S. Pat. No. 5,977,712, however, it is not easy to adjust a bandwidth in the patent.

SUMMARY OF THE INVENTION

Therefore, an object of the present invention is to provide a waveguide system for an electrodeless lighting device with a compact size capable of adjusting a bandwidth of the resonant frequency by performing an inductive function or a capacitive function using two stubs and thereby capable of having less influence with respect to a resonant frequency variation at an initial lighting and after a complete lighting and of assuring resonance stability.

To achieve these and other advantages and in accordance with the purpose of the present invention, as embodied and broadly described herein, there is provided a waveguide system for an electrodeless lighting device, comprising a waveguide guiding microwave energy outputted from an antenna of a microwave generation means which is fixedly-inserted into an inner surface of the waveguide, and having a slot formed at an inner surface of the waveguide and communicated with a resonator where a bulb is positioned for supplying the microwave energy inside the resonator; a first stub protruded from one inner surface of the waveguide to be placed adjacent to the slot, for an impedance matching with the antenna and tuning with an output frequency of the antenna; and a second stub protruded from an inner surface of the waveguide at a certain interval with the first stub and extending a bandwidth together with the first stub for tuning with the output frequency of the antenna is varied according to an impedance variation of the antenna.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An embodiment of an electrodeless lighting device according to the present invention will be explained with reference to the accompanying drawings hereinafter.

There may exist various embodiments for a waveguide system for an electrodeless lighting device according to the present invention, and the most preferred embodiment therefor will be described hereinafter.

Figure 1:
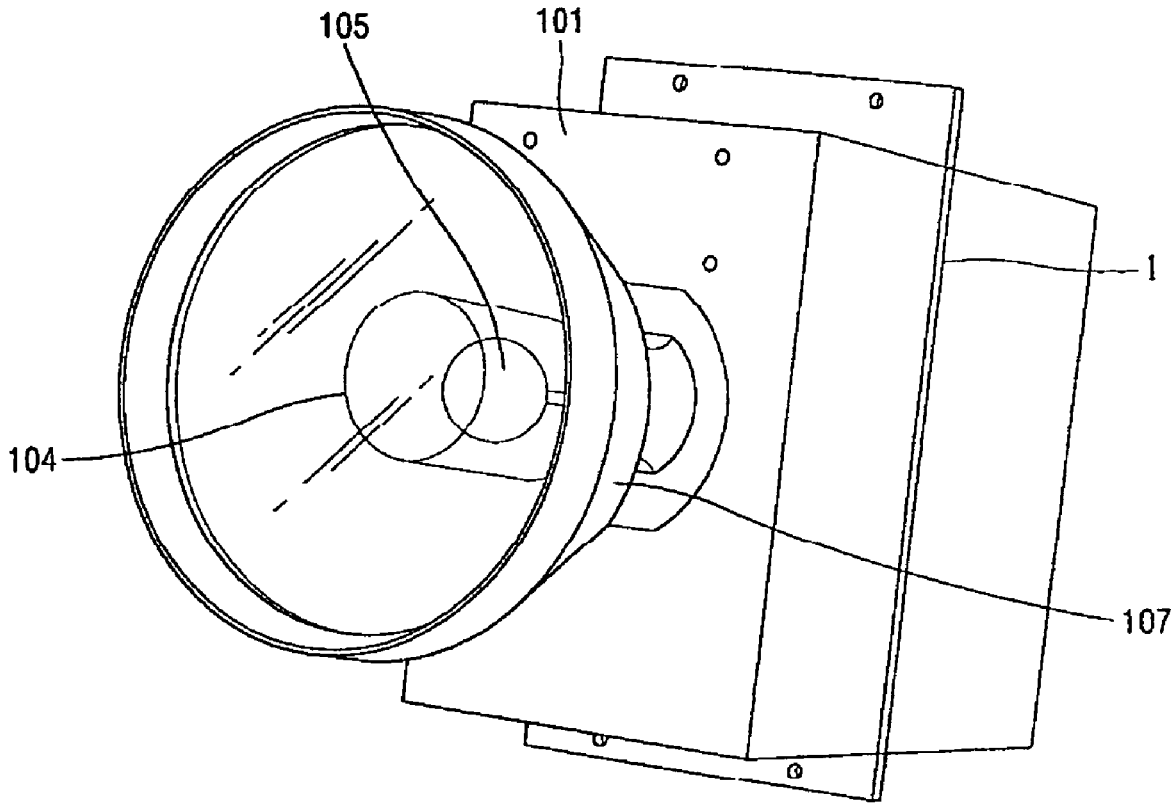
FIG. 1 is a perspective view showing a structure of an electrodeless lighting device having a waveguide system according to the present invention.
Figure 2:
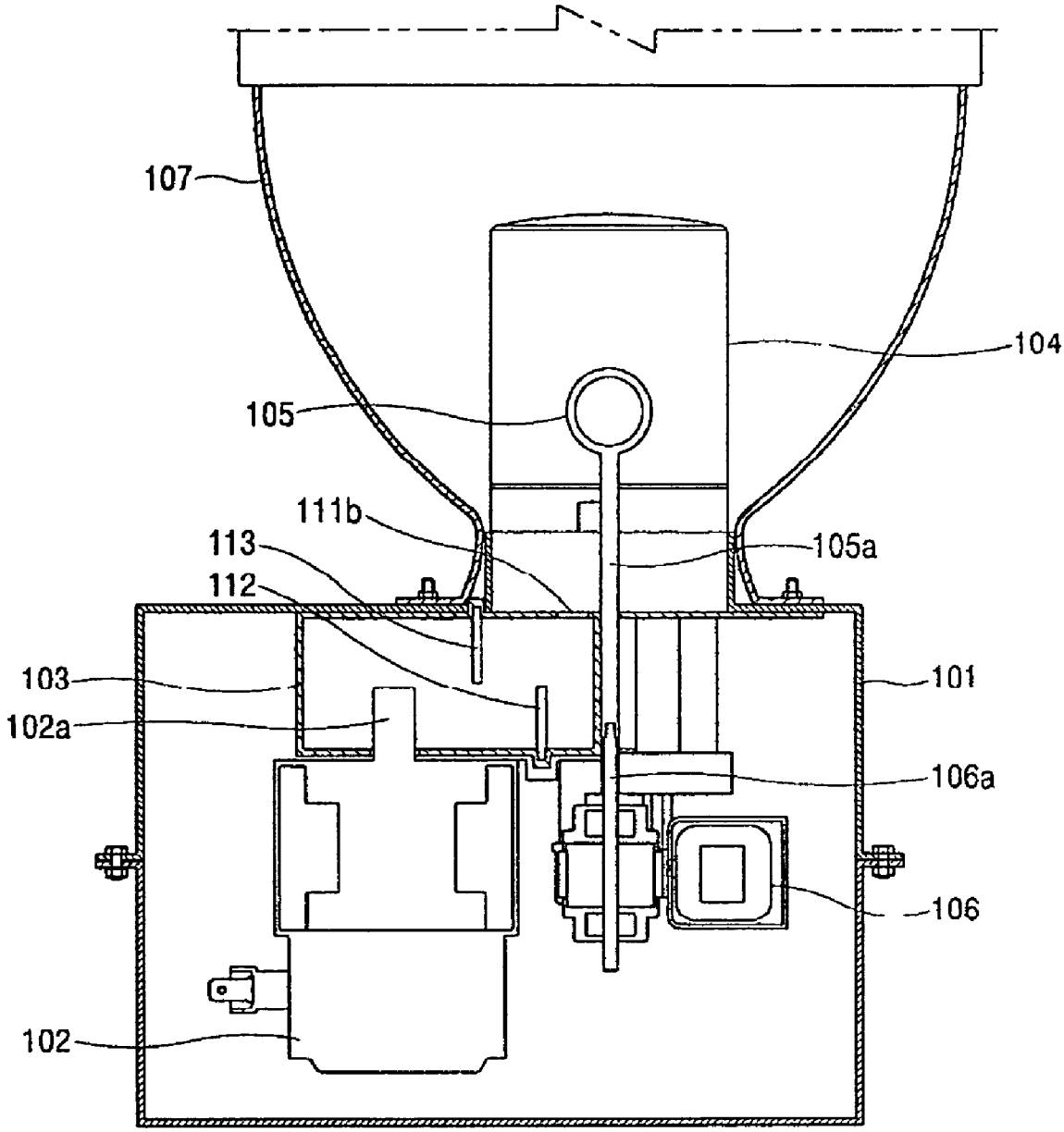
FIG. 2 is a longitudinal sectional view showing an inside of the electrodeless lighting device shown in FIG. 1.
Figure 3:
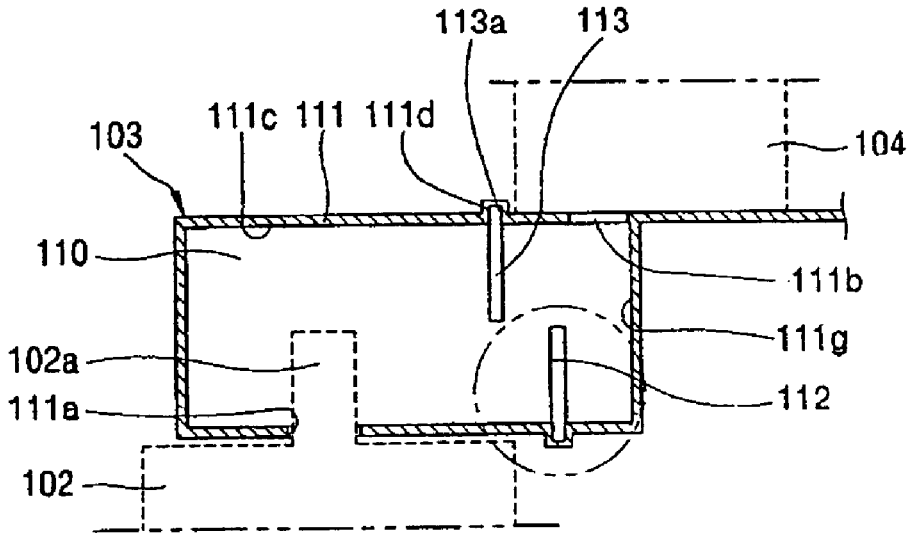
FIG. 3 is a partial sectional view showing an enlarged waveguide according to the present invention.
Figure 4:
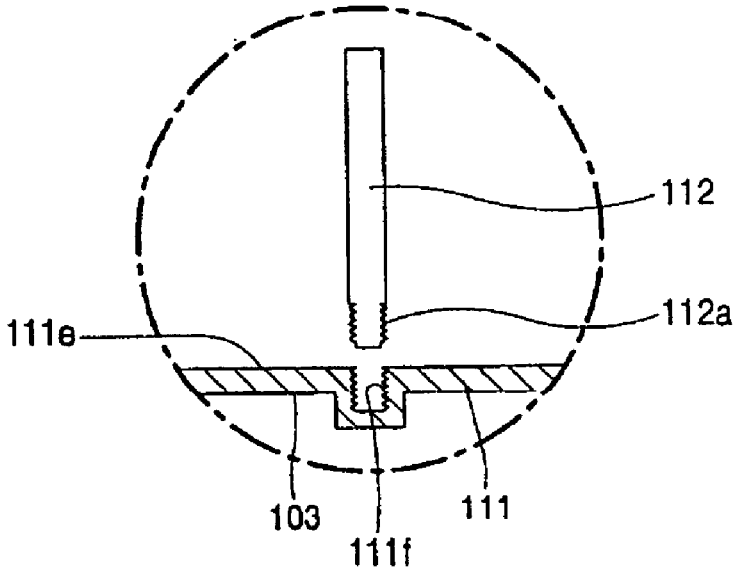
FIG. 4 is an enlarged view showing a stub according to the present invention.

FIG. 1 is a perspective view showing a structure of an electrodeless lighting device having a waveguide system according to the present invention. FIG. 2 is a longitudinal sectional view showing an inside of the electrodeless lighting device shown in FIG. 1. FIG. 3 is a partial sectional view showing an enlarged waveguide according to the present invention and FIG. 4 is an enlarged view showing a stub according to the present invention.

As shown in those Figures, an electrodeless lighting device having a waveguide system based on the present invention is provided with a microwave generation means 102 inside a case 101, for generating microwave energy.

And, a compact size of a waveguide system 103 for guiding the microwave energy generated in the microwave generation means 102 is installed at an upper end portion of the microwave generation means 102. A mesh type resonator 104 for resonating the microwave energy guided through the waveguide system 103 is coupled to an outer side of the case 101.

Furthermore, a spherical bulb 105, in which a luminous material which emits light by the resonated microwave energy is sealed (filled), is installed inside the resonator 104. The bulb 105 is rotated by a motor 106 connected to a motor axis 106*a* placed at a lower end portion of a bulb axis 105*a*.

A reflecting shade 107 for wrapping the resonator 104 is installed at an outer side of the case 101 and thereby light emitted from the bulb 105 is passed through the resonator 104 to thereafter be reflected by the reflecting shade 107.

The waveguide system 103, as can be seen from FIG. 3, includes a waveguide 111 guiding through a path 110 therein microwave energy outputted from an antenna 102*a* of a microwave generation means 102 which is fixedly-inserted into an inner surface of the waveguide 111, and having a slot 111*b* formed at an inner surface of the waveguide 111 and communicated with a resonator 104 where a bulb 105 is positioned for supplying the microwave energy inside the resonator 104, a first stub 112 protruded from one inner surface of the waveguide 111 to be placed adjacent to the slot 111*b*, for an impedance matching with the antenna 102*a* and tuning with an output frequency of the antenna 102*a* and a second stub 113 protruded from an inner surface of the waveguide 111 at a certain interval with the first stub 112 and extending a bandwidth together with the first stub 112 for tuning with the output frequency of the antenna 102*a* is varied according to an impedance variation of the antenna 102*a*.

The waveguide 111 has a rectangular parallelepiped shape formed of a metallic stuff. An antenna insertion portion 111*a*, into which the antenna 102*a* of the microwave generation means 102 is inserted, is formed at one side of a lower portion of the waveguide 111.

A the first stub 112 is installed at an inner wall 111*e* of the waveguide where the antenna is fixedly-inserted to make the protruded end portion of the first stub 112 adjacent to the slot 111*b*. The second stub 113 is installed at a surface 111*c* facing the surface at which the first stub 112 is installed and thereby the end portion of the second stub 113 faces the surface 111*e* at which the first stub 112 is installed.

At this time, the first stub 112 and the second stub 113 are installed to be paralleled with the antenna 102*a* and preferably perpendicular to the surfaces 111*c* and 111*e* where the respective stubs 112 and 113 are installed.

Here, the second stub 113 is preferably placed to be more adjacent to the antenna 102*a* than the first stub 112 in order to optimize a microwave energy transfer.

At this time, there should be a certain interval between the second stub 113 and the antenna 102*a*, thereby capable of preventing an arc-discharge therebetween.

The first and second stubs 112 and 113 are installed to be adjustable for their heights in order to flexibly deal with an impedance matching of the antenna and a resonant frequency tuning.

Referring to FIGS. 3 and 4, the first and second stubs 112 and 113 have male screw portions 112*a* and 113*a*, respectively, at each end portion thereof and female screw portions 111*d* and 111*f* coupled to the male screw portions 112*a* and 113*a* are formed at an inner surface of the waveguide 111. According to this, the stubs 112 and 113 can be easy to be installed and also heights of the first and second stubs 112 and 113 can be adjusted according to a coupling degree between the male screw portions 112*a* and 113*a* and the female screw portions 111*e* and 111*f*.

Moreover, preferably, the first and second stubs 112 and 113 is formed in a cylindrical shape, and it is possible to be formed in a polygon shape according to conditions of the impedance matching and the resonant frequency tuning.

Also, thicknesses of the first and second stubs 112 and 113 preferably have thicknesses of 1 to 10 mm according to conditions of the impedance matching and the resonant frequency tuning.

The electrodeless lighting device having the waveguide system according to the present invention, constructed as aforementioned, will be operated as follows.

When a high voltage is provided to the microwave generation means 102, microwave energy is generated, which is thereafter guided through the waveguide 111, and then emitted into the resonator 104 through the slot 111*b* of the waveguide 111. A luminous material sealed in the bulb 105 is discharged by the emitted microwave energy to generate light by plasma. Such generated light illuminates forward with being reflected by the reflecting shade 107.

At this time, as stated above, the impedance matching and an output frequency tuning of the antenna 102*a* of the microwave generation means 102 can be easily achieved by the first and second stubs 112 and 113 installed in the waveguide 111, and a bandwidth of the resonant frequency can be also extended.

Here, the first stub 112 and the second stub 113 can be considered as a equivalent circuit of a serial LC (i.e., inductance and capacitance).

Figure 5A:
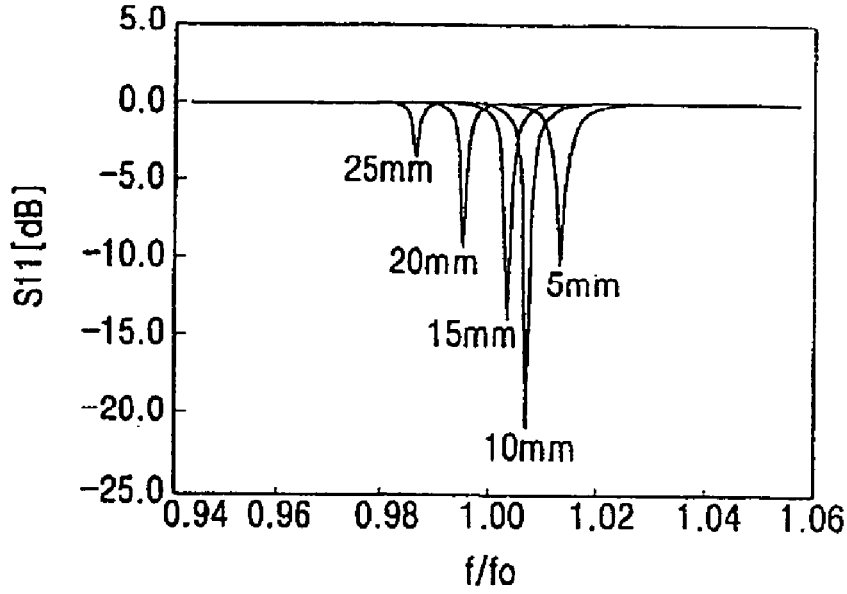
FIGS. 5A to 5C are graphs showing S11 frequency passing characteristics.
Figure 5B:
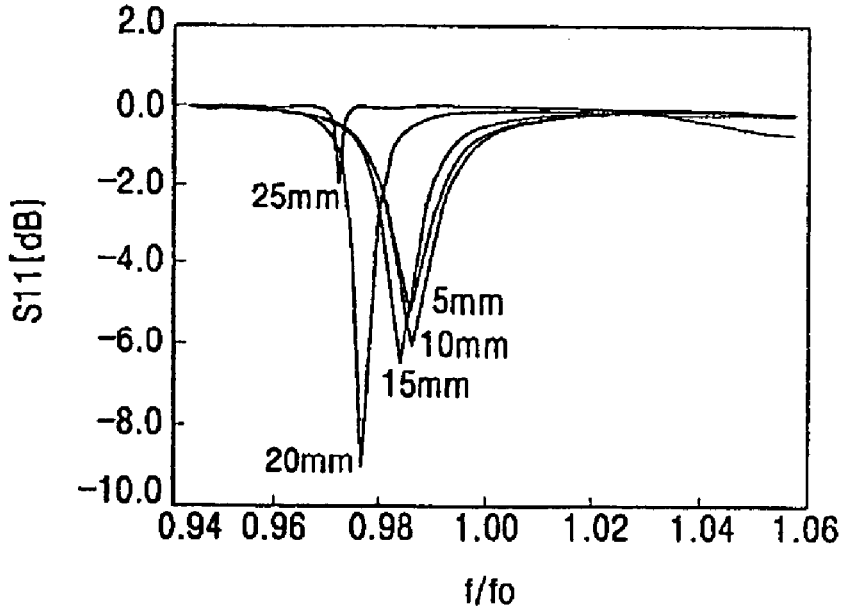
Figure 5C:
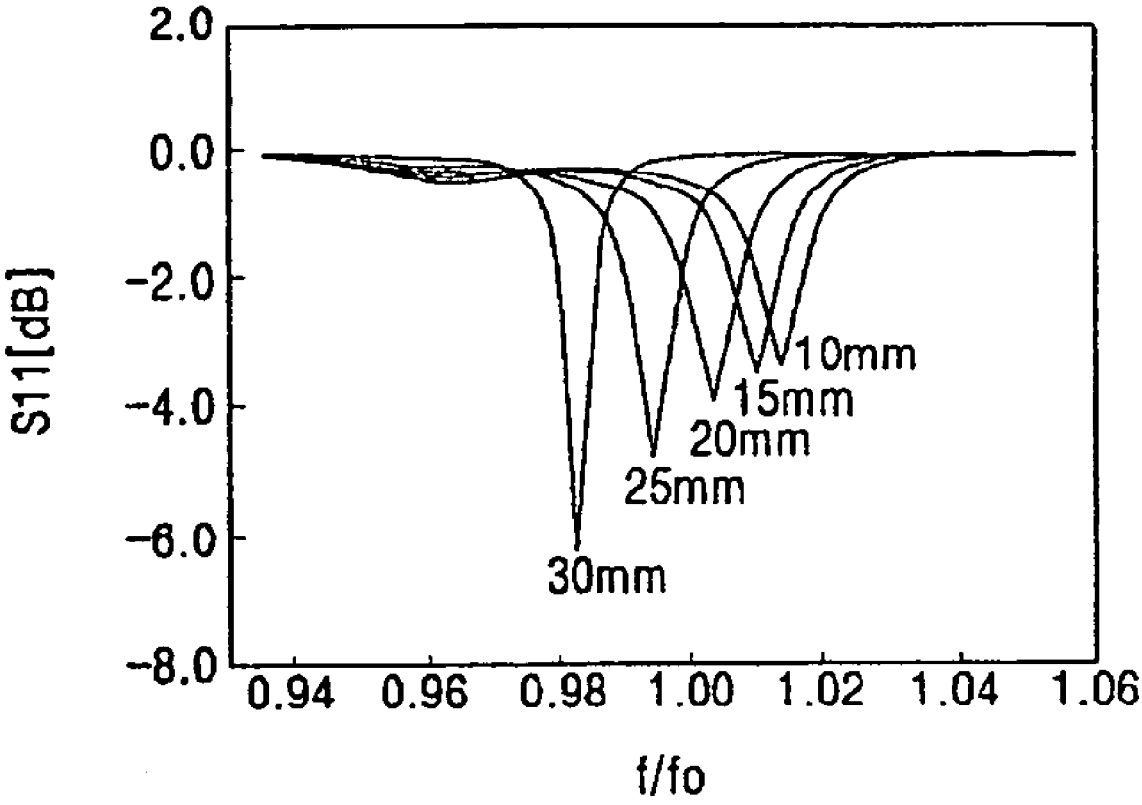

FIGS. 5A to 5C are graphs showing S11 frequency passing characteristics, in which 'S11' denotes a reflection coefficient, 'f' denotes a variable frequency, 'f0' denotes a resonant frequency, wherein in case of f/f0=1, a resonant frequency matching can be precisely achieved.

That is, the first stub 112 is installed at an inner surface of the waveguide 111, namely, at the surface 111*e* in which the antenna 102*a* is fixedly-inserted, and thereby the impedance of the antenna 102*a* is matched between the waveguide 111 and the resonator 104. That is, once varying the height of the first stub 112, values L and C are varied and the impedance of the slot 111*b* is also varied. As a result of this, as shown in FIG. 5A, the impedance matching can be realized depending on the variation of the resonant frequency.

However, according to the impedance variation of the magnetron antenna 102*a*, as can be seen from FIG. 5B, since there can be a limitation of a tuning range, the second stub 113 is installed at an opposite position to the first stub 112 in order to stably realize the impedance matching and to prevent an arc-discharge with the antenna 102*a*.

Therefore, as shown in FIG. 5C, the lengths of the first stub 112 and the second stub 113 are combined to achieve a frequency matching with respect to an arbitrary impedance of the antenna 102*a*.

Additionally, the first stub 112 and the second stub 113 are installed at opposite positions to each other and the end portion of the first stub 112 is placed adjacent to the slot 111*b* thereby to efficiently obtain a compact size of the waveguide 111. The first stub 112 is placed adjacent to a inner lateral surface 111*g* of the waveguide 111 thereby to obtain an effect that the inner lateral surface 111*g* can be moved. According to this, a resonant frequency tuning can be realized by simultaneously considering an influence by a reflected wave at the inner lateral surface 111*g* as well.

Moreover, when the length of the stubs 112 and 113 and the interval between the stubs 112 and 113 are appropriately adjusted, a quality factor (Q) value is varied as well as the resonant frequency is precisely tuned and thereby a bandwidth can be adjusted. (the Q value is in inverse proportion to the bandwidth)

Additionally, in the electrodeless lighting device, since the waveguide 111 is coupled to the resonator 104, an impedance variation of the antenna 102*a* of the microwave generation means 102 is occurred and thereby resonance is surely occurred at an arbitrary frequency although the resonant frequency is not matched to a target value. Therefore, an initial resonant frequency shift can be realized in the compacted electrodeless lighting device by applying the two stubs 112 and 113 facing each other, as aforementioned, to the waveguide 111. Thus, one of the two stubs 112 and 113, namely, the first stub 1112 is used to occur an initial resonance at an appropriate frequency, and the other stub, namely, the second stub 113 is used to be precisely matched to a frequency applied from the antenna 102*a*. According to this, the Q value is decreased and the bandwidth is properly extended thereby to improve a stabilization of the resonance.

Figure 6A:
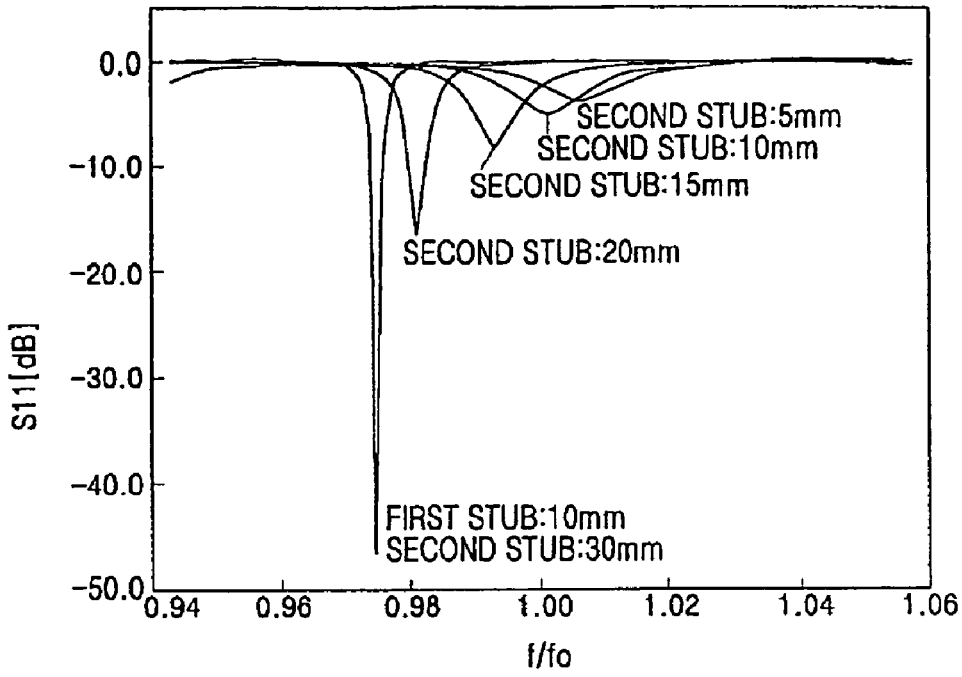
FIGS. 6A and 6B are graphs for S11 frequency passing characteristics showing a state of an extended bandwidth according to a length adjustment of a stub in accordance with the present invention.
Figure 6B:
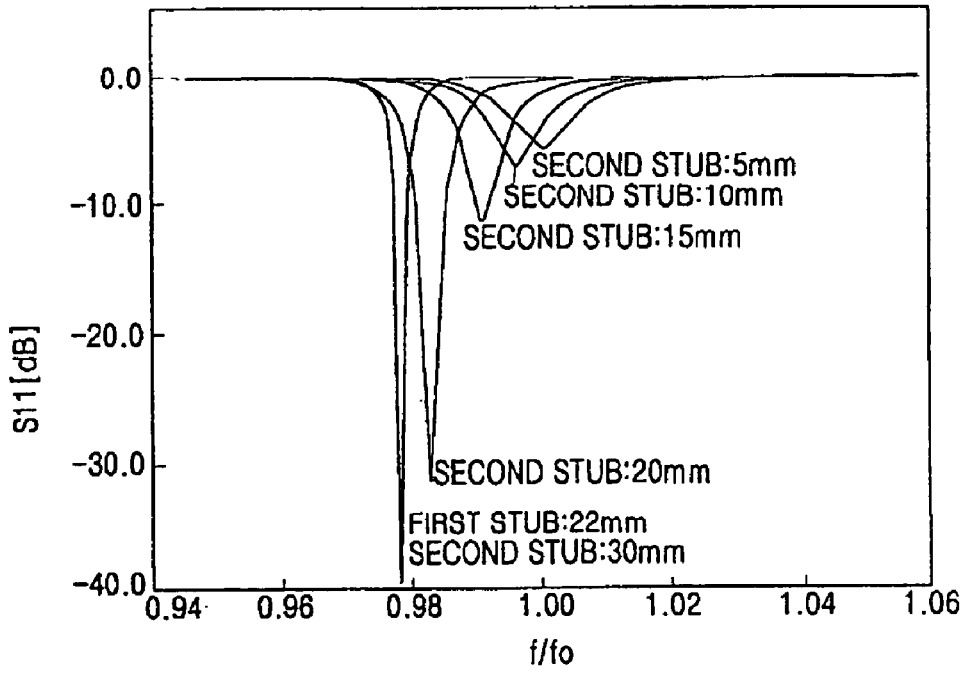

FIGS. 6A and 6B are graphs for S11 frequency passing characteristics showing a state that a bandwidth is extended according to a length adjustment of a stub according to the present invention. Similarly to FIG. 5, 'S11' is a reflection coefficient, 'f' is a variable frequency, 'f0' is a resonant frequency, wherein in case of f/f0=1, a resonant frequency matching can be precisely achieved.

Referring to FIG. 6A, once shortening the length of the second stub 113, it can be noticed that the bandwidth is extended as well as a resonant frequency becomes precise. However, if the bandwidth is overextended, the reflection coefficient becomes great, which results in a difficulty for the mostest support of power.

On the other hand, as shown in FIG. 6B, if the length of the first stub 112 is slightly lengthened and the length of the second stub 113 is shortened in a state of shifting an initial resonant frequency toward the right side, the bandwidth, as shown in FIG. 6A, is decreased more as well as a resonance becomes precise thereby to drop the reflection coefficient S11. According to this, a transmission power of the microwave energy can be increased.

That is, the precise resonance can be achieved by using the two stubs 112 and 113, and if the bandwidth and the reflection characteristics are adjusted, a frequency stability and an efficiency of support power can be increased.

As stated above, in the waveguide system of the electrodeless lighting device based on the present invention, two stubs are installed at opposite positions to each other with a certain interval therebetween in the waveguide and thereby one of the two stubs is used to occur an initial resonance at an appropriate frequency and the other stub is used to be resonated at a target value as well as adjusting the Q value, which results to adjust the bandwidth appropriately. As a result of this, it is possible to use the compact size of the waveguide and advantageous to improve a resonance stability.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A waveguide system for an electrodeless lighting device, comprising:

a waveguide guiding microwave energy outputted from an antenna of a microwave generation means which is fixedly-inserted into an inner surface of the waveguide, and having a slot formed at an inner surface of the waveguide and communicated with a resonator where a bulb is positioned for supplying the microwave energy inside the resonator;

a first stub protruded from one inner surface of the waveguide to be placed adjacent to the slot, for an impedance matching with the antenna and tuning with an output frequency of the antenna; and a second stub protruded from an inner surface of the waveguide at a certain interval with the first stub and extending a bandwidth together with the first stub for tuning with the output frequency of the antenna is varied according to an impedance variation of the antenna.

2. The system of claim 1, wherein a protrusion end portion of the first stub is placed adjacent to the slot, and the second stub is installed at a surface facing the surface at which the first stub is installed and thereby the end portion of the second stub faces the surface at which the first stub is installed.

3. The system of claim 2, wherein the first and second stubs are installed to be paralleled to the antenna.

4. The system of claim 3, wherein the second stub is placed more adjacent to the antenna than the first stub is.

5. The system of claim 4, wherein the second stub is placed far from the antenna with a certain interval in order to prevent an arc-discharge therebetween.

6. The system of claim 1, wherein the first and second stubs are installed to be adjustable for heights thereof.

7. The system of claim 6, wherein the first and second stubs have male screw portions at respective end portions thereof, and female screw portions coupled to the male screw portions are formed at an inner surface of the waveguide thereby to adjust a protrusion height.

8. The system of claim 1, wherein the first and second stubs are formed in cylindrical shapes.

9. The system of claim 1, wherein the first and second stubs are formed in polygon shapes.

10. The system of claim 1, wherein the first and second stubs have a thickness of 1 to 10 mm.

11. The system of claim 1, wherein the first and second stubs are formed of a metallic material.

* * * * *